US005118920A

United States Patent [19]

Tanabe et al.

[11] Patent Number: 5,118,920

[45] Date of Patent: Jun. 2, 1992

[54] IMAGE FIXING APPARATUS

[75] Inventors: Masatoshi Tanabe, Chigasaki; Shokyo Koh, Yokohama; Yoshihiko Suzuki, Tokyo; Satoshi Mori, Yokohama; Koki Kuroda, Tokyo, all of Japan

[73] Assignee: Canon Kabushiki Kaisha, Tokyo, Japan

[21] Appl. No.: 622,498

[22] Filed: Dec. 5, 1990

[30] Foreign Application Priority Data

Dec. 11, 1989 [JP] Japan ..... 1-322347
Jan. 12, 1990 [JP] Japan ..... 2-005070

[51] Int. Cl.[5] ..... G03G 15/20
[52] U.S. Cl. ..... 219/216; 355/290
[58] Field of Search ..... 219/216, 469, 470, 471; 219/388; 355/289, 290; 392/417

[56] References Cited

U.S. PATENT DOCUMENTS

| | | | |
|---|---|---|---|
| 3,745,307 | 7/1973 | Peek | 219/388 |
| 3,810,735 | 5/1974 | Moser | 219/216 |
| 3,811,828 | 5/1974 | Ohta et al. | 432/227 |
| 3,813,677 | 5/1974 | Shimosuma | 219/216 |
| 3,864,709 | 2/1975 | Bruns | 219/216 |
| 4,049,947 | 9/1977 | Bestenreiner | 219/216 |
| 4,118,178 | 10/1978 | Calvi | 219/216 |
| 4,354,095 | 10/1982 | deVries | 219/388 |

FOREIGN PATENT DOCUMENTS

| | | | |
|---|---|---|---|
| 551152 | 1/1958 | Canada | 219/388 |
| 0295901 | 12/1988 | European Pat. Off. . | |
| 0331075 | 9/1989 | European Pat. Off. . | |

*Primary Examiner*—Teresa J. Walberg
*Attorney, Agent, or Firm*—Fitzpatrick, Cella, Harper & Scinto

[57] ABSTRACT

An image fixing apparatus includes a heater; a film movable together with a recording material in contact with the heater, wherein a visualized image on the recording material is heat-fixed by heat from the heater through the film; a driver for driving the film; wherein the driver stops the film after power supply to the heater is stopped.

10 Claims, 11 Drawing Sheets

IMAGE FIXING APPARATUS

FIELD OF THE INVENTION AND RELATED ART

The present invention relates to an image fixing apparatus for heat-fixing a toner image on a recording material through a film.

As for an image fixing system for fixing a toner image on a recording material, a heat-roller type fixing system is widely known. However, the heat roller fixing system requires a longer warming up period for the surface of the heating roller to reach a predetermined temperature.

In EP0295901 A3, which has been assigned to the assignee of this application there is proposed a new image fixing apparatus using a fixedly supported heater having a low thermal capacity and a film slidable on the heater.

In the system using the heater and the slidable film, if the film is continuously driven, the problem of noise, wearing of the surface of the film contactable to the heater and the like arise. For this reason, it is preferable to stop the film when the fixing operation is not carried out.

However, if the temperature of the heater is very high and if the film is stopped and then left as it is, it may be damaged. The film is stuck on the pressing roller, and/or foreign matter is adhered to the fixing film, with the result of the damage to the film.

SUMMARY OF THE INVENTION

Accordingly, it is a principal object of the present invention to provide an image fixing apparatus wherein even if the heater is repeatedly energized and deenergized, the film driving operation can be satisfactorily performed.

It is another object of the present invention to provide an image fixing apparatus wherein the film is not moved when the fixing operation is not carried out.

It is a further object of the present invention to provide an image fixing apparatus wherein the film drive is stopped after the heater is deenergized.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
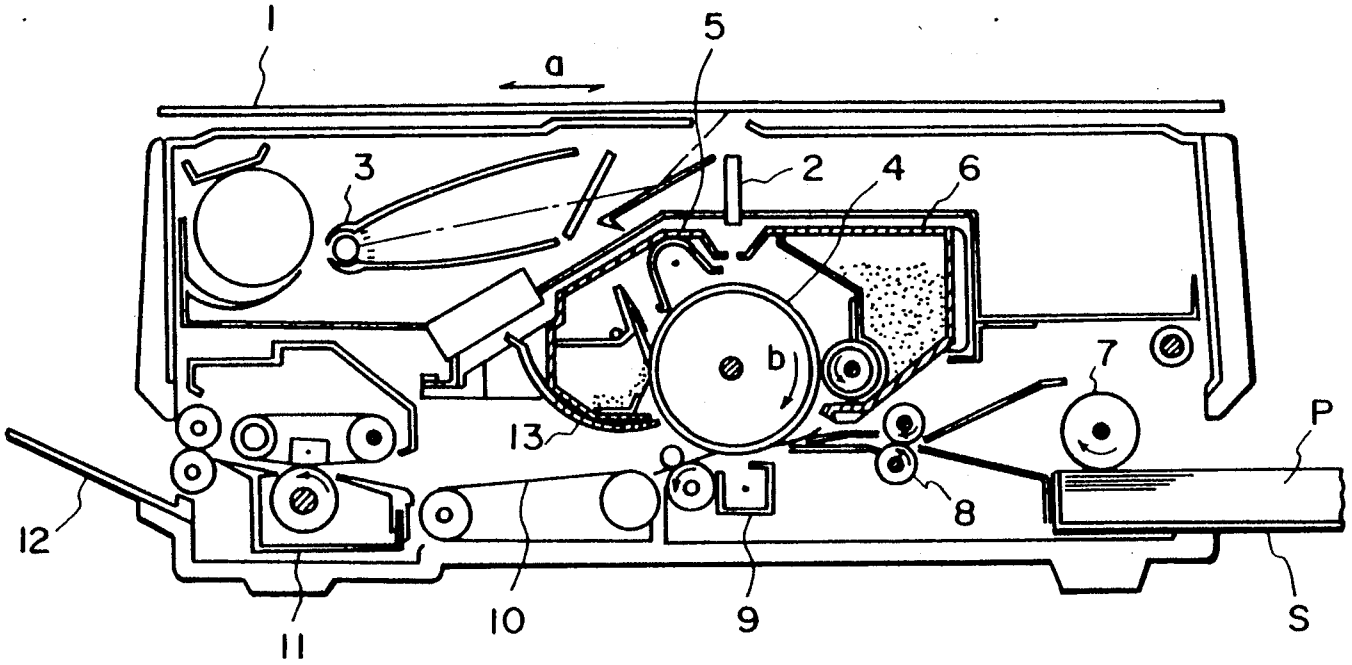
FIG. 2 is a sectional view of an image forming apparatus using the fixing apparatus according to the embodiment of the present invention.

Referring to FIG. 2, the description will first be made as to an image forming apparatus using an image fixing apparatus according to an embodiment of the present invention.

The image forming apparatus comprises an original supporting platen 1 made of transparent material such as glass and reciprocable in the directions indicated by an arrow a, an array 2 of small diameter imaging elements having short focus length disposed right below the original supporting platen, an original illuminating lamp 3 in the form of a fluorescent tube for illuminating an original placed on the original supporting platen. The light reflection by the original is imaged through a slit on a photosensitive drum 4 through the array 2. The photosensitive drum rotates in the direction b. A charger 5 uniformly charges the photosensitive drum 4 which is coated with zinc oxide photosensitive layer or an organic photoconductive photosensitive layer, for example. The drum 4 uniformly charged by the charger 5 is exposed to image light through the array 2, so that an electrostatic latent image is formed. The electrostatic latent image is developed by a developing device 6 with toner made of resin or the like which is softened or fused by heat.

On the other hand, a recording sheet P accommodated in a cassette S is fed to the drum 4 by a pick-up roller 7 and a pair of registration rollers 8 press-contacted vertically to each other, with a timed relation with the image on the photosensitive drum 4. The toner image formed on the photosensitive drum 4 is transferred onto the sheet P by a transfer charger 9. Thereafter, the sheet P is separated from the drum 4 by known separating means and is introduced into an image fixing apparatus 11 along a conveyance guide 10. In the fixing apparatus 11, the image is fixed on the sheet P, and the sheet P is discharged onto the tray 12. After the toner image is transferred, the toner remaining on the photosensitive drum 4 is removed by a cleaner 13.

Figure 3A:
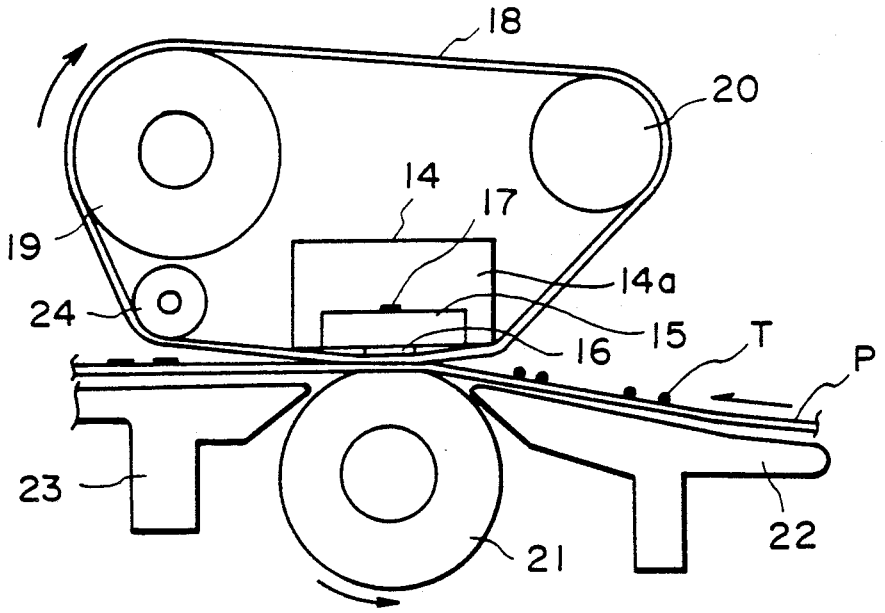
FIG. 3A is a sectional view of an image fixing apparatus according to an embodiment of the present invention.

Referring to FIG. 3A, the image fixing apparatus 11 according to an embodiment of the present invention is shown in an enlarged view.

It comprises a low thermal capacity linear heater 14 stationarily disposed in the apparatus. For example, it includes an alumina base plate 15 having a thickness of 1.0 mm, a width of 1.0 mm and a length of 2.40 mm and a resistance material 16 (heat generating layer) of 1.0 mm width applied on the base plate 15. The heater is connected at its longitudinal opposite ends to an electric power source, by which it can produce heat. The film side surface of the heater is coated with lubricant oil. The alumina base plate is supported by a holder 14*a* through heat insulating material.

The supplied energy in this embodiment is pulse waves of DC 100 V and the frequency of 20 ms. In this embodiment, the width of the pulse applied to the resistance material 16 is changed in accordance with emission of the thermal energy so that a temperature sensor 17 detects a controlled predetermined level of the temperature. The pulse width ranges from 0.5 ms–5 ms in this embodiment. A fixing film 18 moves in the direction indicated by an arrow in contact with the heater 14 thus controlled in the temperature (the energy supplied thereto). An example of the fixing film comprises a heat resistive film having a thickness of 20 microns made of, for example, polyimide, polyether imide, PES or PFA, and a parting layer at least at its image contactable side, the parting layer comprising fluorinated resin such as PTFE or PFA to which conductive material is added. The parting layer has a thickness of 10 microns coated on the heat resistive film. It is in the form of an endless belt. Generally, the total thickness thereof is 100 microns, and preferably less than 40 microns. The film is driven by the driving force and the tension force provided by a driving roller 19 and a follower roller 20 in a direction indicated by an arrow, without crease.

A pressing roller 21 has a rubber elastic layer of silicone rubber or the like having a good parting property. It press-contacts the film to the heater with a total pressure of 4–7 kg. The transfer material P having the unfixed toner T is fixed into the fixing position by an inlet guide 22, and the toner is fixed by the heat generated described above. Thus, a fixed image is produced. Designated by reference numerals 23 and 24 are a sheet discharge guide and a separation roller.

The foregoing description has been made with respect to the case where the film is in the form of an endless belt.

Figure 3B:
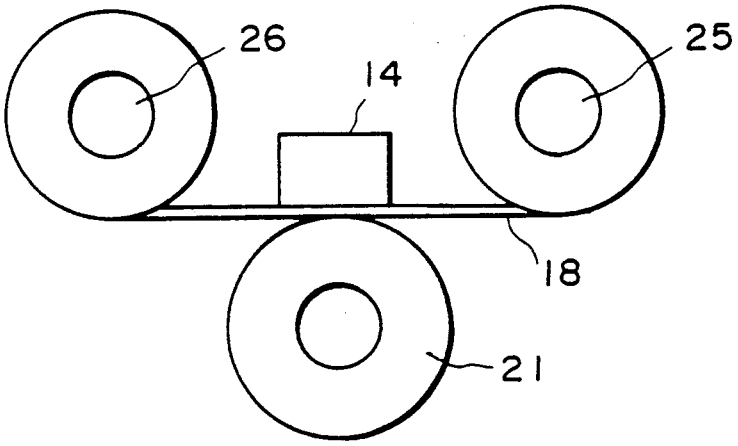
FIG. 3B is a sectional view of an image fixing apparatus according to another embodiment of the present invention.

Referring to FIG. 3B, the fixing film may be in the form of a non-endless film, in which the film is extended between a supply shaft 25 and a take-up shaft 26.

The image fixing apparatus of the present invention is applicable to any apparatus such as a copying machine, printer or facsimile machine which forms an image with toner. In addition, the present invention is applicable to the fixing or image improvement of a visualized image provided through a process in which light, heat or pressure is applied to microcapsules to produce colors so that an image is formed.

Figure 1:
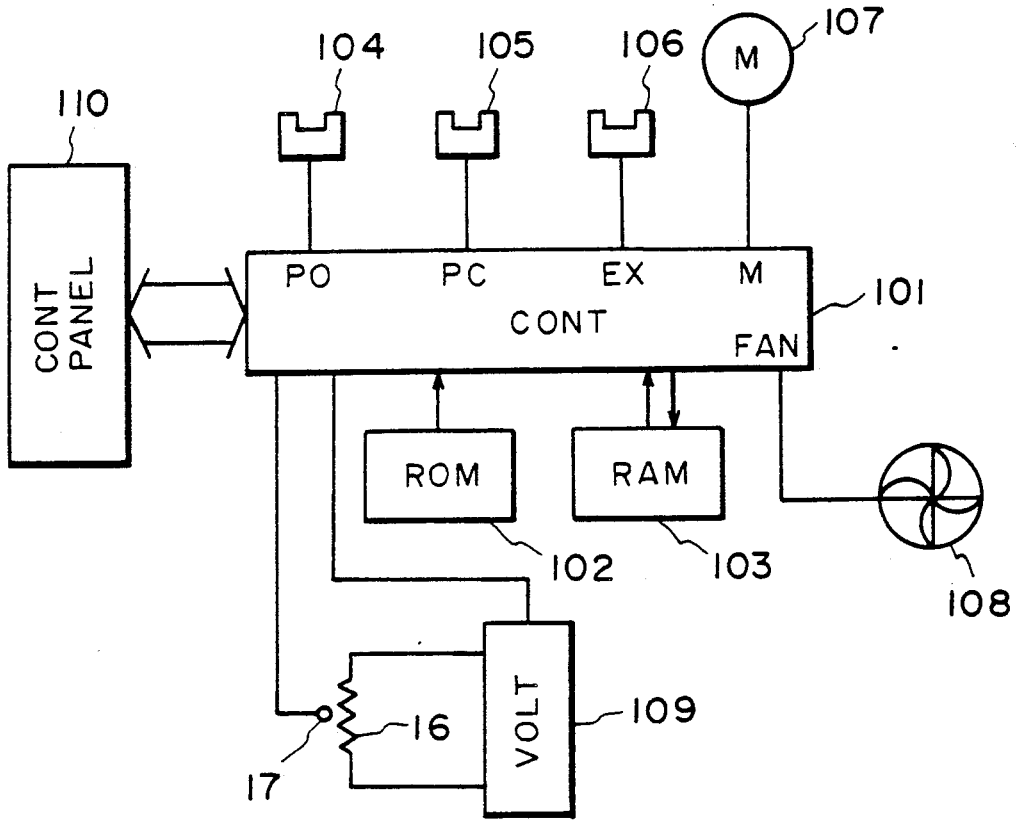
FIG. 1 is a block diagram of a control system used in an image fixing apparatus according to an embodiment of the present invention.

Referring now to FIG. 1, the description will be made as to the control operations of the image forming apparatus shown in FIG. 2. FIG. 1 is a block diagram of a control system of an image forming apparatus shown in FIG. 2. The control system comprises a control circuit 101 having a microcomputer or the like, a ROM 102 storing control data or control program to be effected by the control circuit and a RAM (random access memory),103 performing the control. The control circuits PO, PC and EX receive signals from sensors, more particularly from an original supporting platen position sensor 104, a sheet feed sensor and a sheet discharge sensor 106. Each of the sensors is constituted by a photointerruptor and a light blocking member. When the light blocking member is detected, a high level 1 is produced at the associated inlet port PO, PC or EX. Designated by a reference character M is a drive output signal for a motor 107. A main motor is operatively connected with the fixing film, so that the film starts to be driven by the main motor. The control circuit 101 is connected with an operation board 110, so that various key inputs by the operator and the information display are effected.

Figure 4:
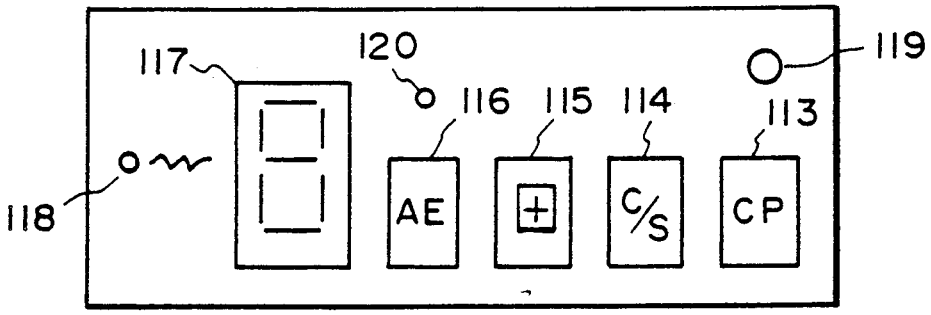
FIG. 4 is a top plan view of an operation panel of the image fixing apparatus of FIG. 2.

FIG. 4 shows an example of such an operation board. A power lamp 119 is on when the main switch is closed. A jam indicating lamp 118 is lit on when the sheet P is jammed. A seven segment display 117 displays error or jam in association with the jam indicating lamp. It also displays a number in response to key operation in the form of a seven segment display. The operation board is provided further with a copy key 113 for starting the copy operation, a clear key 114 for resetting the number of copies to be produced, a plus key 115 and an AE key 116 for automatically setting the optimum image density. An AE lamp 120 displays the AE mode.

Referring back to FIG. 1, reference numeral 16 designates a heat generating layer. A temperature sensor 17 such as a thermister detects the temperature of the alumina base plate 15 having a good thermal conductivity, and therefore, it is effective to substantially detect the temperature of the heat generating layer 16. A power source 109 supplies energy to the heater. A fan 108 is provided to discharge the heat and inside air.

Figure 5:
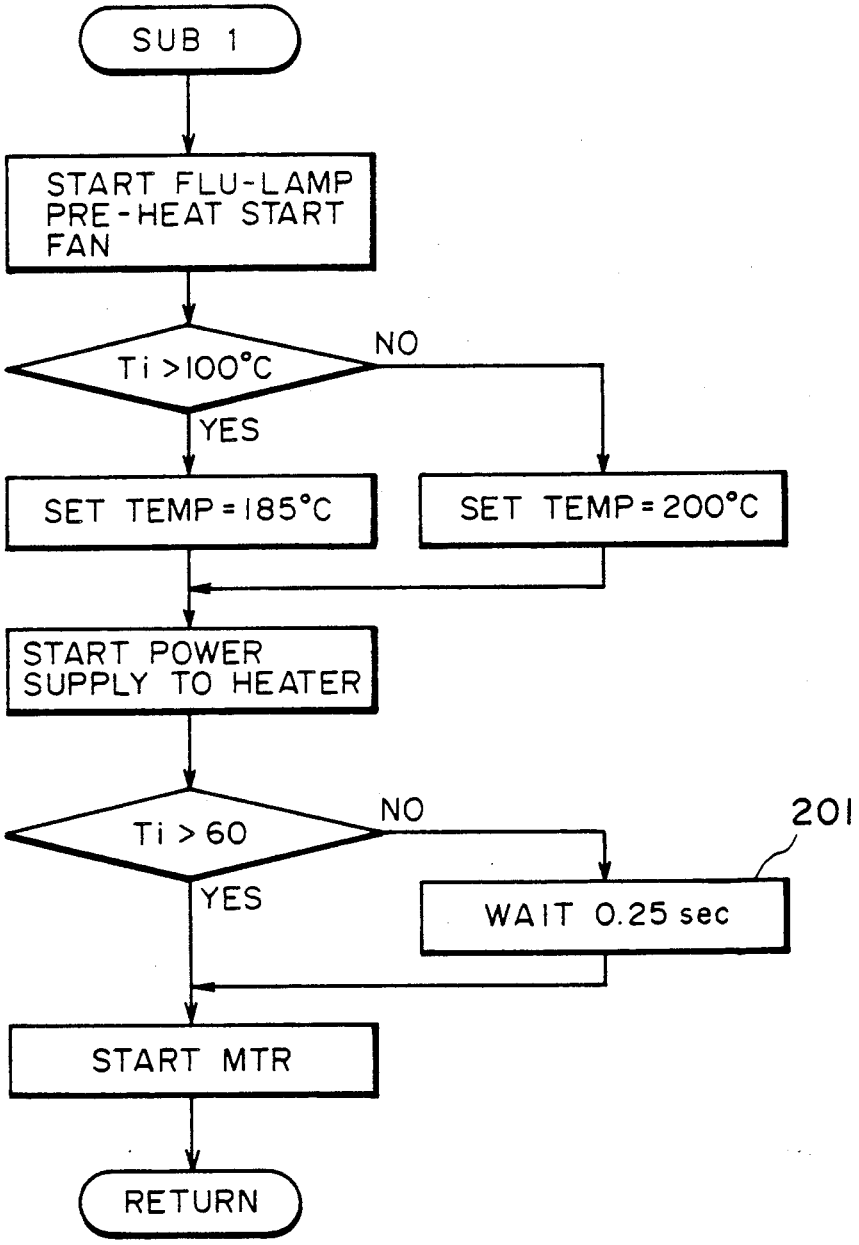
FIGS. 5, 6 and 7, are flow charts illustrating the operation of the image fixing apparatus according to the embodiment of the present invention.

Referring to the flow charts of FIGS. 5, 6 and 7, the control operation of the control circuit 101 will be described. FIG. 5 shows a sub routine to be accessed upon actuation of the copy key, that is, upon the image forming operation to be started in response to an image formation signal. In this sub-routine control, a pre-heating operation is started to actuate the fluorescent lamp for illuminating the original. It is determined whether the temperature Ti of the heater before the heater is energized upon the copy key actuation is higher than a predetermined first temperature, for example, 100° C. If it is lower, than the first temperature the target temperature for the heater is set to 200° C.; if it is higher, the target temperature is set to 185° C., for example. The heat generating layer 16 is supplied wit electric energy from the power source 107 so that the thermister detects the above target temperature.

If the temperature Ti is higher than a second predetermined temperature, for example, 60° C., the main motor is driven simultaneously with start of energization of the heat generating layer 16 to drive the film. If it is lower, the main motor is driven after a predetermined period of time, for example 0.25 sec, after the start of the energization of the heat generating layer 16.

The temperature Ti is stored in the RAM 103. Together with the energization of the heat generating layer, the fan is driven to discharge the heat in the image forming apparatus.

After the operation of the sub-routine SUB 1, and after the fluorescent lamp pre-heating period (predetermined period) elapses, the fluorescent lamp is turned on, and the copying operation is started.

Figure 6:
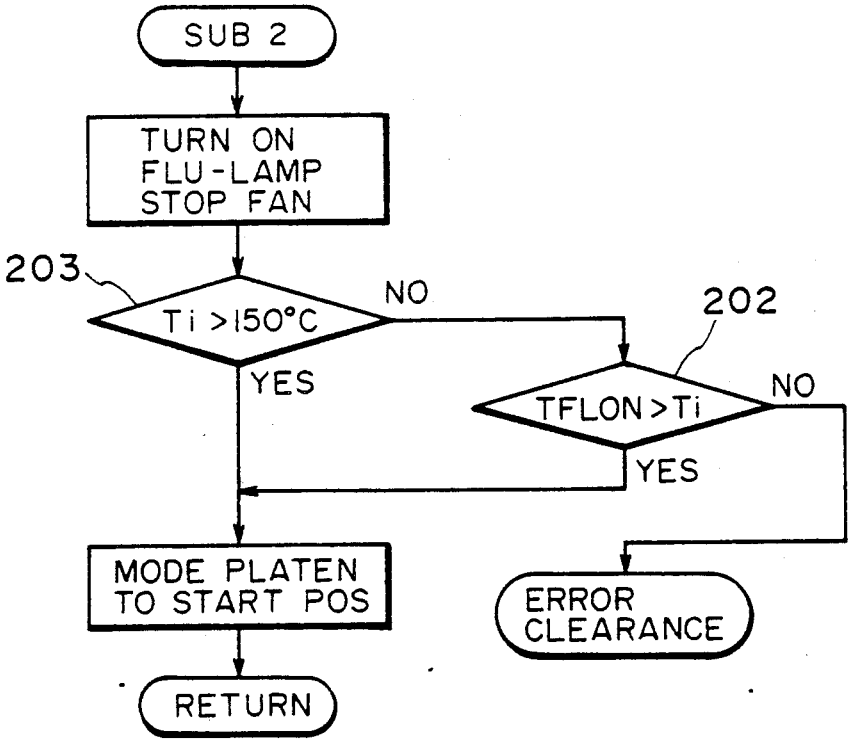
Figure 7:
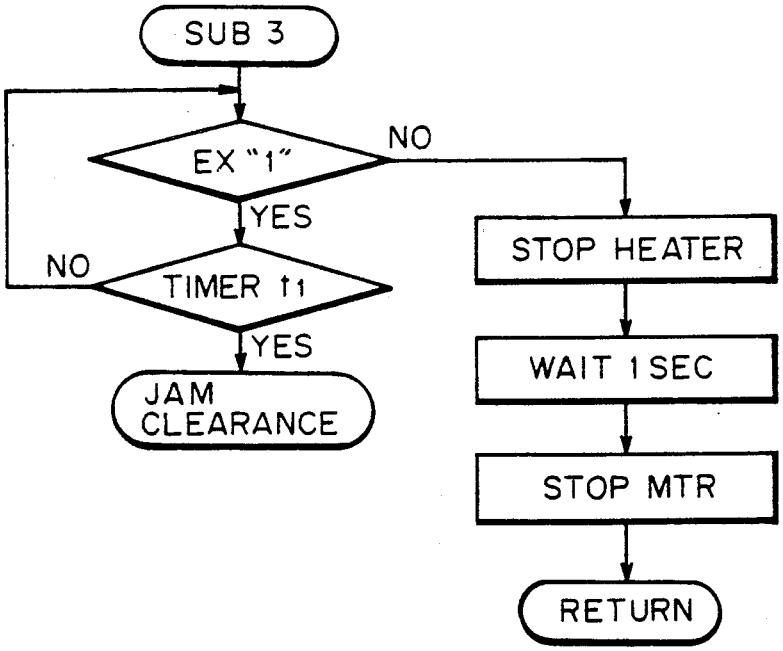

FIG. 6 shows a sub-routine accessed upon actuation of the fluorescent lamp.

In a sub-routine SUB 2, the fan for the heat discharge is stopped, and the fluorescent lamp is turned on. By the stoppage of the fan, the air flow around the fluorescent lamp is stopped to assist the rising delay of the fluorescent lamp in the cold start. Then, a comparison is made between the temperature Ti stored in the RAM 103 and the current heater temperature Tflon to discriminate a malfunction of the thermister or the heat generating layer (202). If the temperature Ti is higher than a third predetermined temperature, (203) for example 150° C., the operation 202 is not performed. By changing the afterward processing depending on the temperature Ti, erroneous discrimination of the malfunction can be avoided even if the difference between the target temperature and the temperature Ti is small despite the absence of a malfunction. When the thermister or the heater is in order, the original supporting platen is moved backwardly by an original supporting platen driving solenoid, and the original supporting plate is stopped at the start position with the aid of an original position sensor 104. If a malfunction is detected, the copying operation is stopped, and the event is displayed on the seven segment display or jam indicating lamp on the operation board.

After the light quantity of the fluorescent lamp becomes sufficient, and at a predetermined point of time, for example, a high voltage power supply is started, the fan is driven again.

After the original supporting platen stops at the start position, an image forming operation is performed through the copying process described in the foregoing. When the copying process is completed, and the sheet P is discharged from the image fixing apparatus, the sheet discharge sensor 106 detects the sheet. Thereafter, the power supply to the heater is stopped. After a predetermined period $t_0$ elapses, for example, after one second elapses, the motor is stopped, and the copying operation is terminated (FIG. 7) In sub-routine SUB 3 (FIG. 7) $t_1$ indicates a timer period of a timer for detecting a jam of the discharged sheet, and is determined in accordance with dimensions and sheet conveying speed in the image forming apparatus. Since the fixing film is post-rotated, that is, since it is rotated even after the stoppage of the power supply to the heater, the surface temperature of the film can be decreased. Accordingly, the damage and/or sticking of the film due to local heating of the film, can be avoided.

Figure 8A:
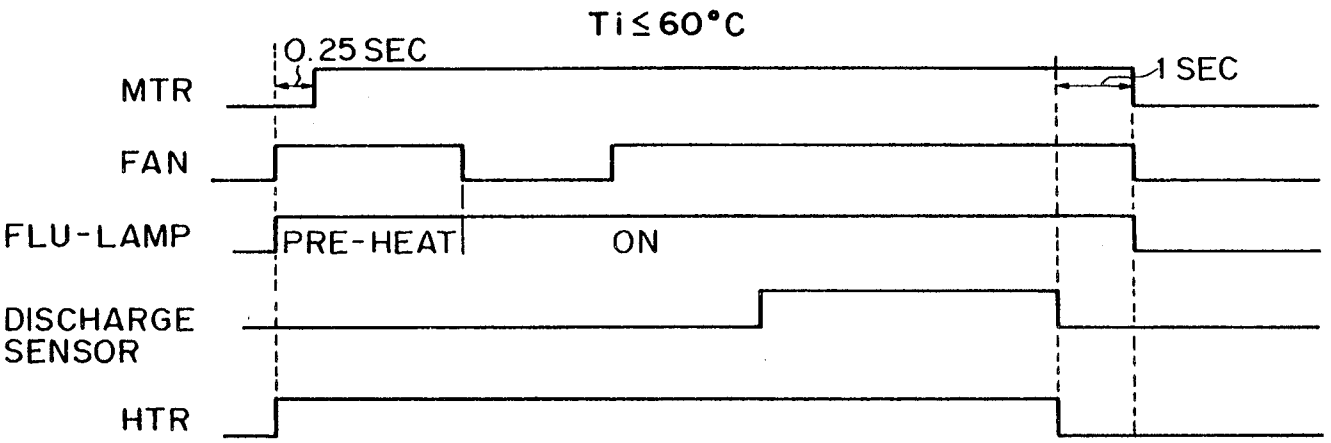
FIG. 8 is a timing chart illustrating the operation of the image fixing apparatus according to the embodiment of the present invention.
Figure 8B:
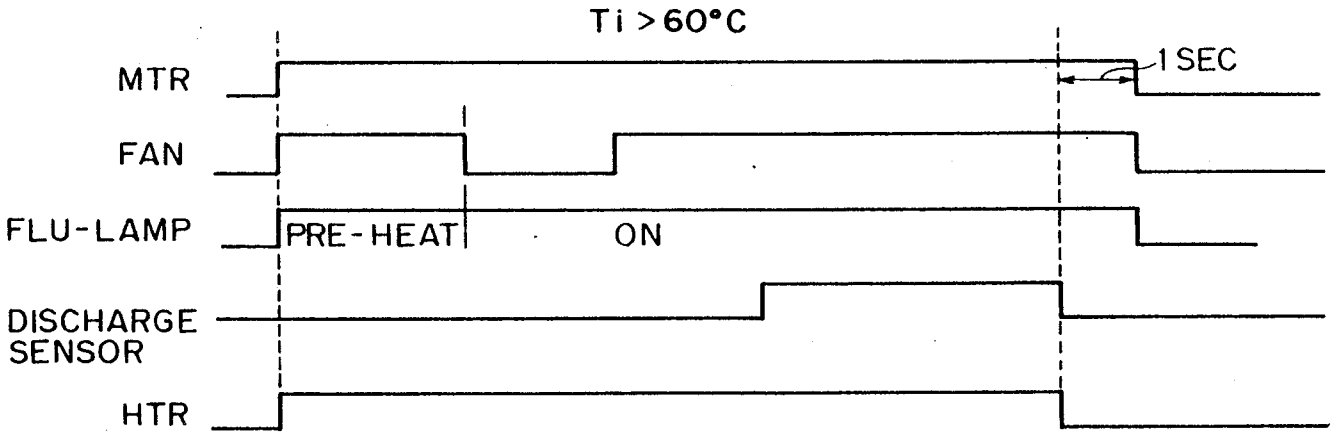

FIGS. 8A and 8B are timing charts when the heater temperature Ti is not higher than 60° C. upon the image formation start, and when the temperature Ti is higher than 60° C., respectively.

Another embodiment of the present invention will be described.

In the foregoing embodiment, the film is stopped a predetermined period after the power supply to the heater is terminated. In the present embodiment, the film is stopped when the temperature of the heater decreases to a predetermined level.

Figure 9:
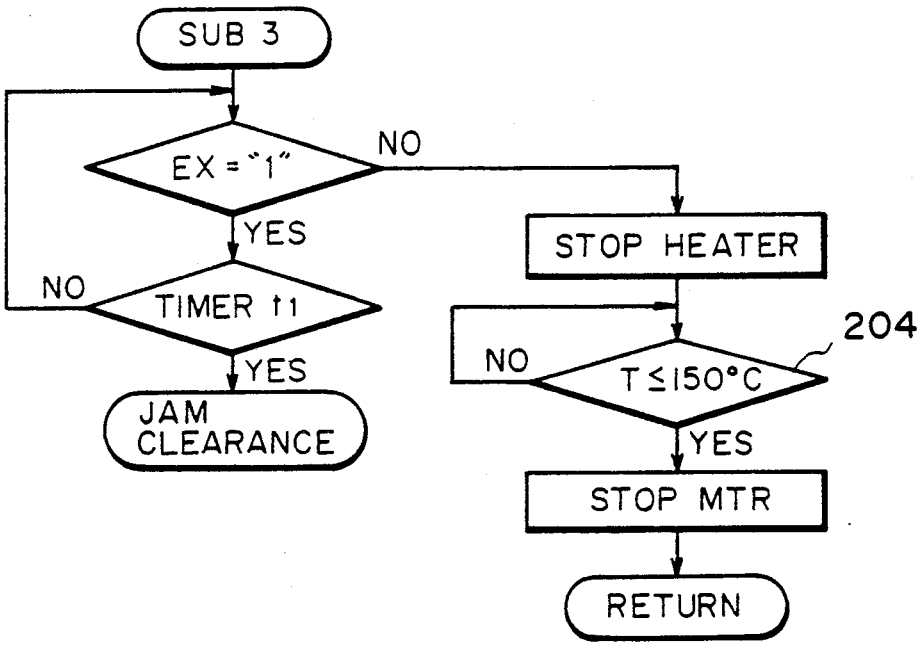
FIGS. 9 and 10 are flow-charts illustrating operations of the image fixing apparatus according to a further embodiment of the present invention.

FIG. 9 is a flow chart illustrating the operation of this embodiment. FIG. 9 is a flow chart of the operation after the sheet P has passed through the image fixing position. When the sheet discharge sensor 106 detects the discharge of the sheet P through the fixing apparatus, the control circuit stops the power supply to the heater. The motor continues to drive the film until the temperature T of the heater decreases to the predetermined level (not less than 150° C., for example) When it reaches 150° C. or lower, the motor is stopped to stop the film (204).

Figure 10:
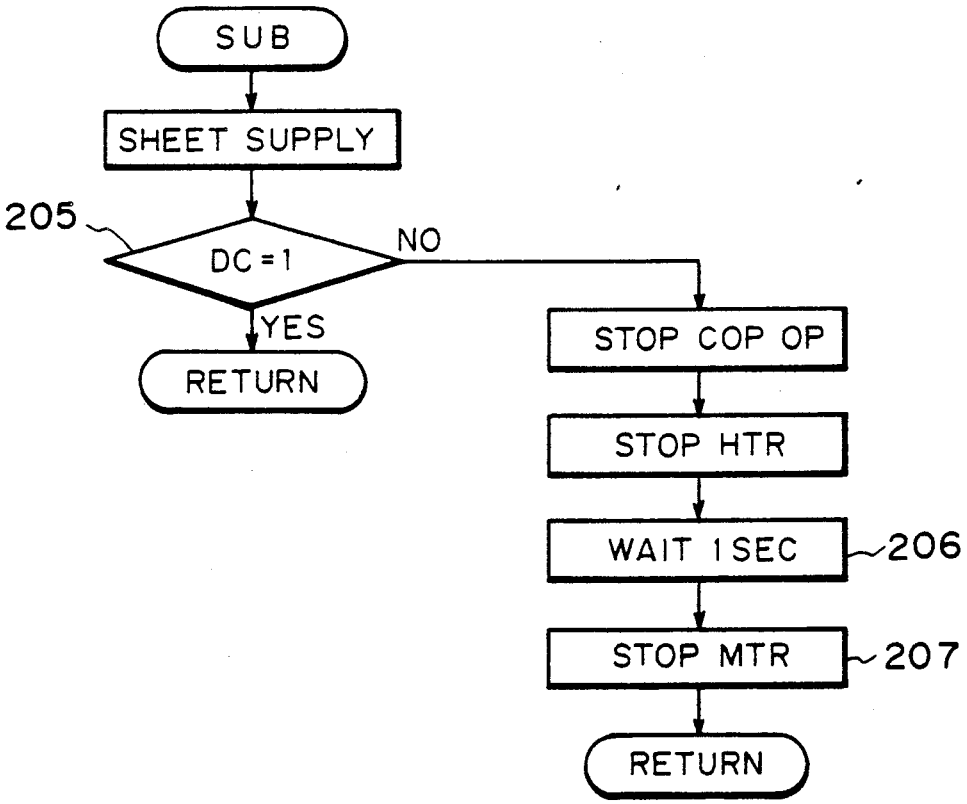

The description will be made as to the operation for discriminating the presence or absence of the sheet in a sheet cassette. After actuation of the copy key, a sub-routine shown in FIG. 5 is executed. Thereafter and before the fluorescent lamp is turned on, the sheet supplying operation is performed. The flow chart for the sub-routine is shown in FIG. 10.

In this sub-routine, the sheet supply operation is effected first using a sheet supply solenoids (not shown). After this, the presence or absence of the sheet P is discriminated on the basis of an output of the sheet feed sensor 105. When the signal PC is "1" (presence of the sheet P is discriminated by the sheet feed sensor), the operation of the sub-routine is terminated, and the copying operation is continued (205). When the signal PC is "0", the copying operation is stopped, and the power supply to the heater is stopped. After a predetermined period, 1 second, for example elapses (206), the motor is stopped (207), and the operation is terminated. Then, the absence of the sheet is displayed on the seven segment display of the operation board 110 in the form of "P", for example. Thus, if there is no sheet, the power supply to the heater and the drive by the motor are not stopped simultaneously with the stoppage of the copying operation, but the stoppage of the motor drive is delayed relative to the shut-off of the power supply to the heater, by which the temperature decrease of the film and the heater is promoted. In the second embodiment, the motor may be stopped after the power supply to the heater is stopped and after the temperature of the heater T decreased to the predetermined level.

A further embodiment will be described.

Figure 13:
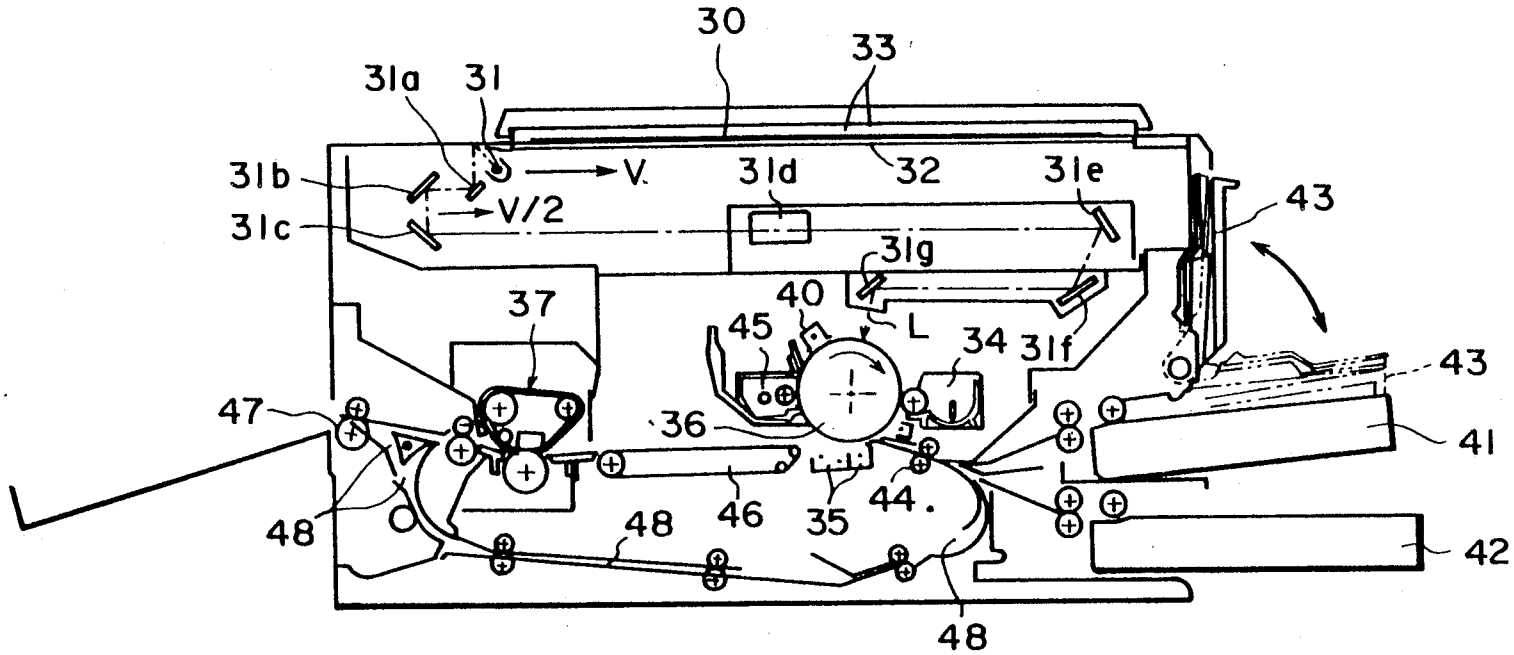
FIG. 13 is a sectional view of another image forming apparatus to which the image fixing apparatus according to the present invention is usable.

FIG. 13 is a sectional view of another image forming apparatus to which the fixing apparatus of the present invention is applicable. The image forming apparatus comprises a fixed original supporting glass 32, on which an original 30 to be copied is placed face down at a predetermined reference position. The original is covered with an original cover 33. Upon the copy start operation, the photosensitive member 36 in the form of a rotatable drum is rotated in a direction indicated by an arrow (clockwise direction) at a predetermined peripheral speed (process speed). The peripheral surface thereof is uniformly charged by a charger 40 to a predetermined potential. A movable illuminating lamp 1 and a first movable mirror 1*a* of an imaging optical system is moved at a predetermined speed V, and a second movable mirror 1*b* and a third mirror 1*c* are moved at the speed of V/2, in the direction from the left side to the right side of the original supporting glass 32, that is, in the forward direction. The bottom image surface of the set original 30 is optically scanned from the left side to the right side, by which the scanned image is imaged and projected as light L by way of an imaging lens 31*d*, a fourth fixed mirror 31*e*, a fifth fixed mirror 31*f* and a sixth fixed image 31*g*, the surface of the rotating photosensitive member 36 having been charged by the charger 40. Then, an electrostatic latent image is formed on the surface of the photosensitive member 36 in accordance with the original image.

The latent image is visualized by a developing device 34 with powdery toner (developer) comprising resin material which is softened or fused by heat. The visualized toner image is transferred onto a transfer sheet The transfer sheet has been singled out from a first sheet feed cassette 42, a second sheet feed cassette 42 or a manual feeding means 43, and has been fed to an image transfer position by registration rollers 44 at a timed relation with the visualized toner image on the photosensitive member 36. The transfer position is between the photosensitive member 36 and the transfer and separation charger 35.

The transfer sheet having received the transferred image is transported along a transporting device 46 to an image fixing apparatus 37 where it is subjected to the image fixing operation. It is finally discharged by a discharge roller 47 to the outside of the apparatus as a print (copy) (a simplex copying mode).

When a duplex over superposing copy mode is selected, the simplex copy having discharged from the image fixing apparatus 37, or the copy sheet having the first image, is introduced into a refeeding sheet passage mechanism 48. The sheet is fed again to the transfer position 35 with its facing orientation reversed or retained. Thus, the duplex or superposing copy operation is performed.

After the image transfer, the photosensitive member 36 is cleaned by the cleaning device 45, so that the surface thereof is cleaned for the purpose of being repeatedly used.

Figure 11:
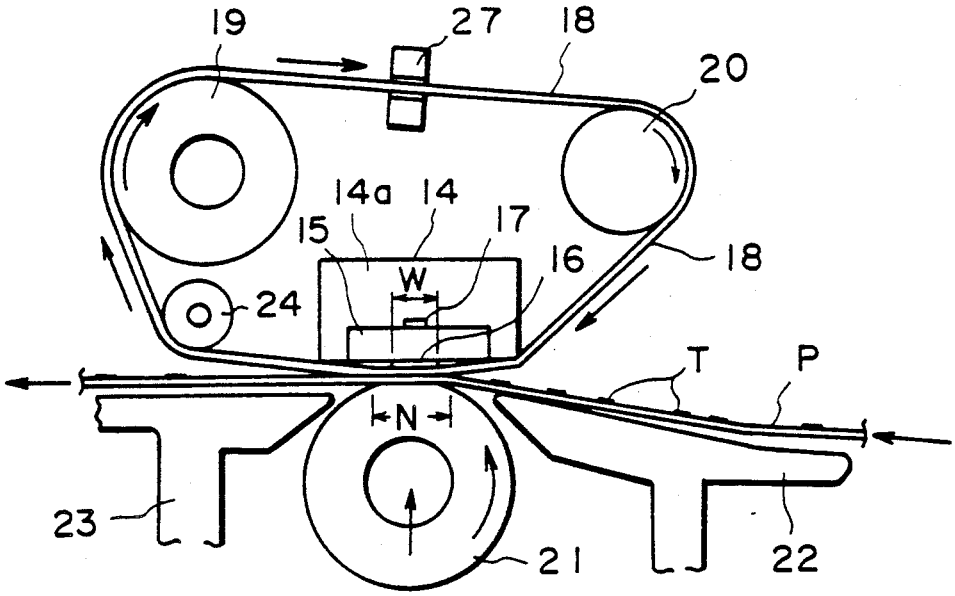
FIGS. 11 and 12 are sectional views of image fixing apparatuses according to further embodiments of the present invention.

FIG. 11 is a sectional view of an image fixing apparatus according to a further embodiment of the present invention. The general structure is similar to the structure of FIG. 3A embodiment Therefore, detailed description of the common elements are omitted.

In this embodiment, the fixing film 18 may be a single layer film of a heat resistive resin material such as polyimide, polyether imide, PES, PFA (copolymer resin of tetrafluoroethylene-perfluoroalkylvinylether) or the like, as well as the one described in connection with FIG. 3A.

The heater supporting member 14*a* functions to provide the entire strength of the heater 14. It may be made of highly heat resistive resin material such as PPS (polyphenylene sulfide), PAI (polyamide imide), PI (polyimide), PEEK (polyether ether ketone), liquid crystal polymer or the like, or a compound material comprising such resin material and a ceramic material, metal, glass or the like.

Figure 12:
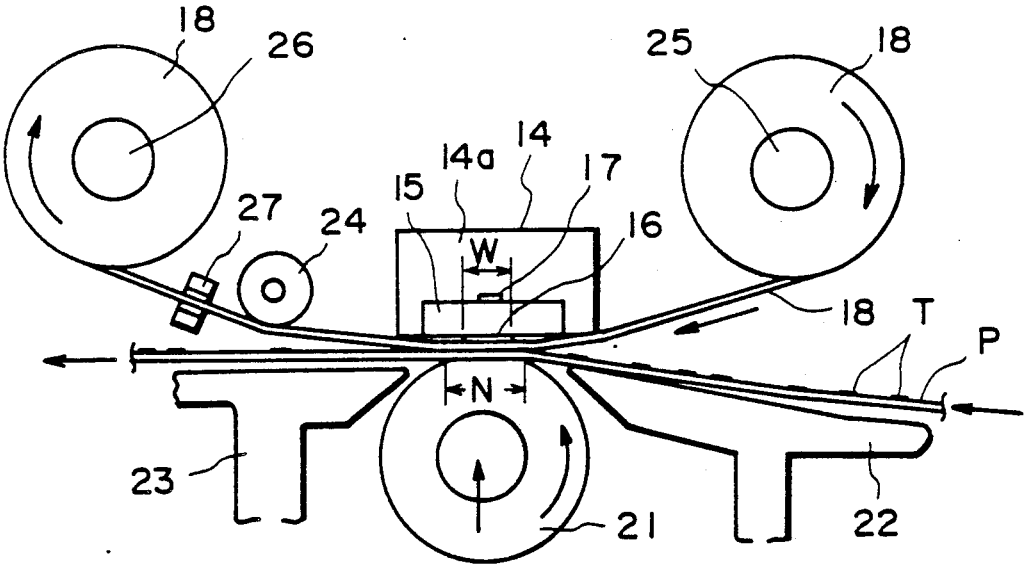

As shown in FIG. 12, the film may be fed at a predetermined speed from a supply reel 25 to a take-up reel 26.

The fixing operation will be described. Upon an image formation start signal, the image forming apparatus is operated, so that the transfer sheet receives an unfixed toner image T at the transfer station. A leading edge of the transfer sheet having the unfixed toner image T on its top surface is detected by an unshown sensor disposed adjacent to the image fixing apparatus. Then, the rotation or travel of the fixing film 18 is started. The transfer sheet 18 is guided by a guide 22, and it is introduced into a nip N (fixing nip) formed between the fixing film 18 and the pressing roller 21. The toner carrying surface of the transfer material is in close contact with the bottom surface of the fixing film 18, and is moved together with the fixing film 18 through the nip between the heater 14 and the pressing roller 21.

A width w of the heat generating element 16 on the bottom side of the heater is within the fixing nip N, more particularly, within the press-contact area between the bottom surface of the heater 14 and the top surface of the pressing roller 14.

The toner image on the toner image carrying side of the sheet P receives the heat from the heat generating element 16 while being passed through the fixing nip N in press-contact with the fixing film surface, through the fixing film 18, so that the toner image is fused at the high temperature and softened and adhered on the surface of the sheet P. In this embodiment, the sheet P and the fixing film 18 are separated from each other at the position where the sheet P has just passed through the fixing nip N.

At this point of separation, the temperature of the fused toner is still higher than the glass transition point of the toner. Therefore, at this point of separation, the adhering force between the sheet P and the fixing film 18 is small, and therefore, the toner hardly offsets to the surface of the fixing film 18, and the sheet does not wrapped around the fixing film 18 due to improper separation. Therefore, the sheet P is smoothly separated at all times without the toner offset and the jam.

Since the temperature of the toner is higher than the glass transition point, it has a proper rubber property, and therefore, the toner image side surface of the sheet P does not follow the surface of the fixing film upon the separation. For this reason, the toner image has proper surface property. The cooled and solidified toner image maintains this surface property. Thus, the fixed toner image is not too glossy, and therefore, has a high quality.

The sheet P separated from the fixing film 18 is guided by a guide 23 to the pair of discharging rollers. During the transportation, the temperature of the toner spontaneously decreases down to a level lower than the glass transition point, and the toner image is solidified. Then, the sheet P having the fixed image is outputted.

In this embodiment, a speed sensor 27 for sensing the movement speed of the film is provided.

Figure 14:
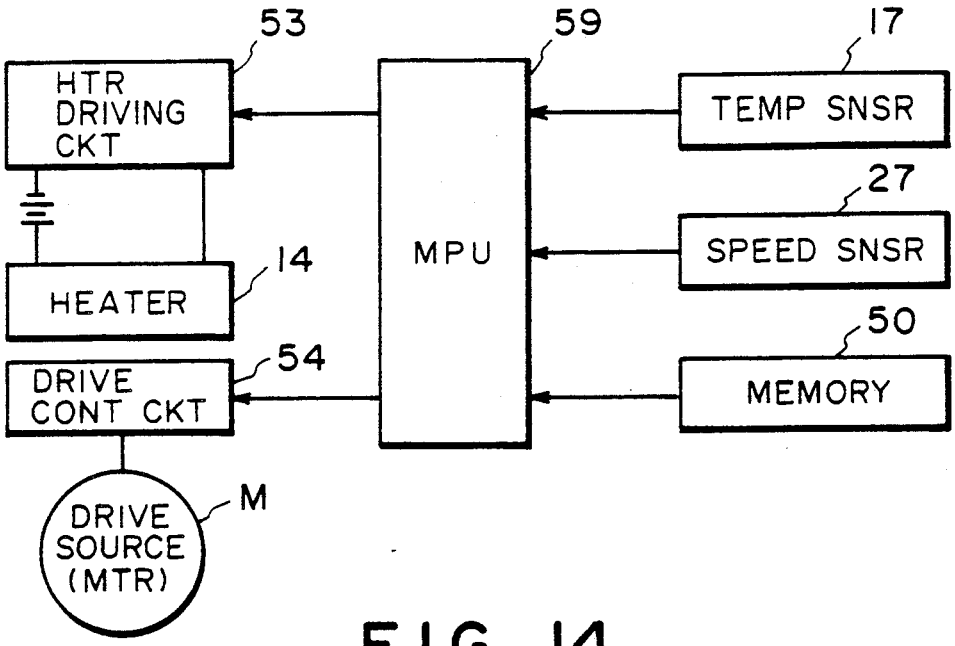
FIG. 14 is a block diagram of a control circuit.

FIG. 14 is a block diagram of a control circuit. The control circuit comprises a microcomputer (MPU) 59, the above-described temperature sensor 17 for the heater 14, a speed sensor 27 for the film 18, and memory 50. The memory 50 stores a predetermined speed Vc of the film 18 suitable for operating the heater and a predetermined temperature Tc which is not influential to the film 18. It further comprises a heater driving circuit 53, a driving source (motor) M for the film moving mechanism, and a drive control circuit 54 for the driving source.

Figure 15:
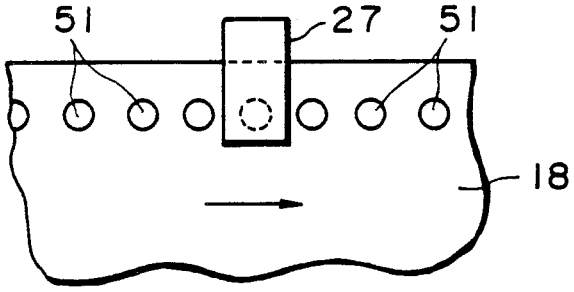
FIG. 15 is a top plan view of an example of a speed detecting means.

The film movement speed sensor 27 is in the form of a photosensor in this embodiment. As shown in FIGS. 11, 12 and 15, it sandwiches without contact the lateral edge portion of the film 18. The film 18 at its end portion has a transparent portion or as alternating light transmitting portions and light blocking portions at predetermined intervals (FIG. 15). When the film 18 moves, the light transmitting and blocking portions are detected by the sensors 27 because the optical path, across the film, of the photosensor 27 is intermittently blocked, and therefore, the photosensor 27 produces pulse signals with pulse intervals and widths corresponding to the movement speed of the film 18. From the signal from the sensor 27, the speed Vx of the film 18 is detected by the MPU 59 using a timer and a counter.

Figure 16:
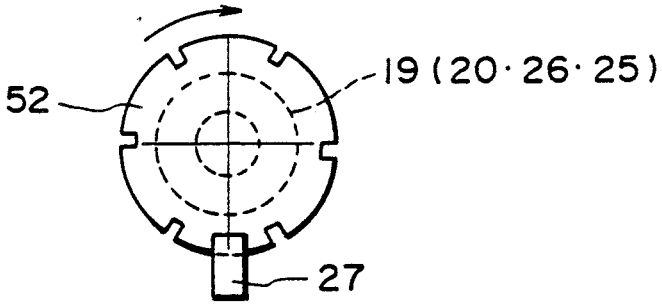
FIG. 16 is a front view of another example of the speed detecting means.

FIG. 16 shows another example of a mechanism for directing the speed. In this example, a slit disk (detecting disk) 52 is integrally mounted to the roller or the shaft such as the film driving roller 19, the follower roller 20 of FIG. 11, or film take-up shaft 26 or supply shaft 25 of FIG. 12. The rotational speed of the roller or the shaft may be detected by the combination of the disk 52 and the photosensor 27, so that the movement speed of the film may be detected. Another means is usable.

Figure 17:
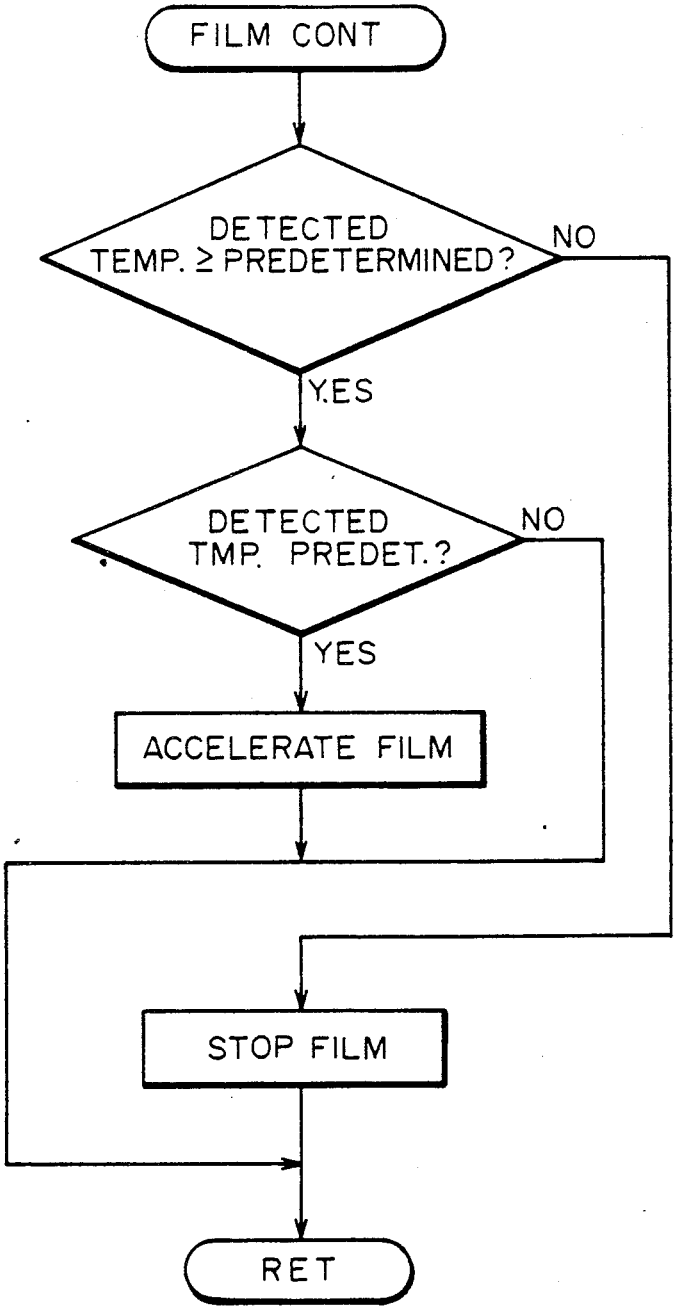
FIG. 17 is a flow chart of a control system for controlling movement of the film.

FIG. 17 is a flow chart for the control of the film movement.

(1) Even after the power supply to the heater (heat generating energization) is stopped after the completion of the fixing operation, the movement of the film is continued. The MPU 59 receives the movement speed Vx of the film 18 detected by the speed sensor 27 and the temperature Tx of the heater 14 detected by the temperature sensor 10.

(2) The MPU 50, having the comparison function, compares the detected speed Vx and the detected temperature Tx with the predetermined speed Vc and the predetermined temperature Tc stored in the memory means 50.

(3) The MPU 59 and the circuit 54 control the driving source for the film driving system so that the film 9 continues to move at a predetermined lower speed until the temperature sensor 17 detects a predetermined temperature which is not influential thermally to the film 9.

(4) When the temperature sensor 10 detects the temperature which is not thermally influential to the film 9, the MPU 19 and the circuit 24 stop the driving source 25 for the film, so that the film is stopped.

According to this embodiment, the movement speed of the film is shifted to a lower level in accordance with the temperature decrease after the power supply to the heater is shut off. Accordingly, noise can be reduced after the power supply to the heater is shut off.

As described in the foregoing, according to the present invention, the local thermal deformation or sticking of the film due to the remaining heat of the heater after operation of the heater is stopped, can be avoided. Therefore, the durability of the film and the heater, that is, the reliability and the durability of the apparatus can be improved.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising a heater to which power is supplied;

a film movable together with a recording material, wherein a visualized image on the recording material is heat-fixed by heat from said heater through said film at a fixing position; and driving means for driving said film, wherein after the recording material passes the fixing position, the power supply to said heater is stopped and thereafter said driving means is stopped.

2. An apparatus according to claim 1, wherein said driving means stops said film a predetermined period after stoppage of the power supply to said heater.

3. An apparatus according to claim 1, further comprising a temperature sensor for sensing a temperature of said heater, wherein said driving means stops said film upon detection, by said temperature sensor, of the temperature of said heater which is not higher than a predetermined temperature.

4. An apparatus according to claim 3, further comprising speed detecting means for detecting a movement speed of said film, wherein the film movement speed after stoppage of the power supply to said heater is in accordance with a temperature detected by said temperature sensor.

5. An apparatus according to claim 1, wherein said heater is fixed in use, and said film slides on said heater.

6. An apparatus according to claim 5, wherein a lubricant agent is present between said heater and said film.

7. An apparatus according to claim 5, wherein said heater has a resistance layer generating heat upon electric power supply thereto, said resistance layer being close to said film.

8. An apparatus according to claim 1, further comprising detecting means for detecting passage of the recording material through the fixing portion, and the power supply to the heater is stopped in response to an output of the detecting means.

9. An apparatus according to claim 1, wherein a surface of said film is contactable to said heater, and the other surface is contactable to the visualized image.

10. An apparatus according to claim 1, wherein said film is of resin material.

* * * * *

UNITED STATES PATENT AND TRADEMARK OFFICE

CERTIFICATE OF CORRECTION

PATENT NO. : 5,118,920

DATED : June 2, 1992

INVENTOR(S) : TANABE et al.

It is certified that error appears in the above-identified patent and that said Letters Patent is hereby corrected as shown below:

On title page, item

[56] REFERENCES CITED

U.S. PATENT DOCUMENTS

Insert: --4,998,121 3/91 Koh et al.
5,043,763 8/91 Koh et al.--

"Shimosuma" should read --Shimotsuma--.

COLUMN 4

Line 39, "lower," should read --lower--; and "temperature" should read --temperature,--.

Line 42, "wit" should read --with--.

COLUMN 5

Line 3, "temperature, (203)" should read --temperature (203),--.

Line 4, "202" should read --(202)--.

Line 12, "plate" should read --platen--.

COLUMN 6

Line 60, "sheet" should read --sheet.--

UNITED STATES PATENT AND TRADEMARK OFFICE

CERTIFICATE OF CORRECTION

PATENT NO. : 5,118,920

DATED : June 2, 1992

INVENTOR(S) : TANABE et al.

It is certified that error appears in the above-identified patent and that said Letters Patent is hereby corrected as shown below:

COLUMN 7

Line 22, "embodiment" should read --embodiment.--

COLUMN 8

Line 10, "wrapped" should read --wrap--.

COLUMN 9

Line 41, "comprising" should read --comprising:--.

Signed and Sealed this

Sixteenth Day of November, 1993

Bruce Lehman

*Attest:*

BRUCE LEHMAN

*Attesting Officer*

*Commissioner of Patents and Trademarks*